United States Patent [19]

Ishida et al.

[11] 4,262,078

[45] Apr. 14, 1981

[54] LIGHT TRANSMITTING PARTICLE FOR FORMING COLOR IMAGE

[75] Inventors: Eisuke Ishida, Nara; Yuji Takashima, Nishinomiya; Yoshihide Miyazawa, Tokyo; Katsuichi Motohashi; Michihiro Gonda, both of Urawa, all of Japan

[73] Assignees: Matsushita Electric Industrial Co., Ltd., Osaka; Hodogaya Chemical Co., Ltd., Tokyo, both of Japan

[21] Appl. No.: 59,740

[22] Filed: Jul. 23, 1979

[30] Foreign Application Priority Data

Jul. 26, 1978 [JP] Japan ..... 53-91938

[51] Int. Cl.[3] ..... G03G 9/10; G03G 13/16

[52] U.S. Cl. ..... 430/109; 430/45; 430/106; 430/126

[58] Field of Search ..... 546/329; 8/2.5 A; 430/45, 106, 109, 126; 427/288, 248 H

[56] References Cited

U.S. PATENT DOCUMENTS

| | | | |
|---|---|---|---|
| 3,969,071 | 7/1976 | Hugelin | 8/2.5 A |
| 4,007,045 | 2/1977 | Ishida et al. | 430/45 |
| 4,121,932 | 10/1978 | Ishida et al. | 430/126 |

FOREIGN PATENT DOCUMENTS

| | | | |
|---|---|---|---|
| 779901 | 10/1934 | France | 546/329 |

*Primary Examiner*—Mary F. Downey
*Assistant Examiner*—John L. Goodrow
*Attorney, Agent, or Firm*—Miller & Prestia

[57] ABSTRACT

Disclosed is a light transmitting particle containing a sublimable color-former that is a pyridine derivative suitable for use in the formation of a color image. This particle can produce a clear color image having little fogging and having an excellent resolving power.

3 Claims, 13 Drawing Figures

LIGHT TRANSMITTING PARTICLE FOR FORMING COLOR IMAGE

The present invention relates to a light transmitting particle or particles suitable for use in the formation of a color image which utilizes optical and chemical properties of such particles and also utilizes electrostatic properties of a sensitized plate. More specifically, it relates to a light transmitting particle or particles for forming a color image, which particle contains a sublimable color-former and produces a yellow color.

A typical known method for forming an image by using particles is a so-called electro print marking process in which particles comprising a photoconductive substance are used. According to this known process, the particles are placed on the surface of a conductive base plate which is grounded, and then, the particles are uniformly charged and imagewise exposed. Thus, particles having weakened or removed electrostatic attracting force between the particles and with the surface of the base plate by the imagewise exposure are removed from the surface of the base plate to obtain a desired image formed by the remaining particles on the base sheet.

In order to obtain a good image having no fogging according to the above-mentioned method, the electric charge of the particles subjected to the light radiation or irradiation must become approximately zero. For this reason, it is important that the particles and the base plate are brought into ohmic contact and that the particles have light transmitting properties. However, in the case where particles in the form of spheres are placed on the surface of base plate as in the conventional methods, there are disadvantages in that, in view of the structure of the particles, not only is it impossible to obtain complete ohmic contact of the particles with the base plate but also electric charges are left in the lower portions of the particles so that much fogging appears in the image. As typical photoconductive substances, such as selenium, zinc oxide and cadmium sulfide, which are employed in conventional methods are opaque, they are not preferable for practical use. Further, where a color image is formed by using the above-mentioned conventional particles and methods, it is necessary to subject the particles (i.e. photoconductive substances) to spectral sensitization. However, there are no suitable sensitizers which can be spectral-sensitized with respect to only blue, green or red. Furthermore, the color development of each respective complementary color has been difficult.

The objects of the present invention are to obviate the above-mentioned disadvantages of the conventional particles, and to provide light transmitting particles for forming a color image, which are capable of producing a clear color image having little fogging and having excellent resolving power.

Another object of the present invention is to provide light transmitting particles capable of forming a color separated image without the use of a color separation filter.

A further object of the present invention is to provide light transmitting particles capable of producing a color image having good color reproduction by only one exposure and one development.

In accordance with the present invention, there is provided a light transmitting particle for use in the formation of a color image containing at least one sublimable pyridine derivative which produces a yellow color on heating in the presence of an electron acceptor and which has the general formula [I];

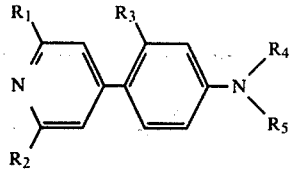

[I]

wherein $R_1$ and $R_2$ are independently hydrogen, phenyl group or chlorine substituted phenyl groups, $R_3$ is hydrogen, lower alkyl groups or lower alkoxy groups, $R_4$ and $R_5$ are independently lower alkyl groups, benzyl group or phenyl group, said lower alkyl groups may be substituted with a cyano group, chlorine or lower alkoxy groups; and a carrier, through which light can be transmitted, for the pyridine derivative having the general formula [I].

The particle of the present invention comprises, as essential constituents, a sublimable color-former which is capable of developing a yellow color and a carrier through which light can be transmitted. The sublimable color-formers used in the present invention, which can develop a yellow color, are pyridine derivatives having the above-mentioned formula [I]. Examples of the pyridine derivatives are 4-(4-N,N-dibenzylaminophenyl)-pyridine, 4-(4-N,N-dimethylaminophenyl)-pyridine, 4-(2-methyl-4-N,N-dimethylaminophenyl)-pyridine, 4-(2-ethoxy-4-N,N-diethylaminophenyl)-pyridine, 4-[4-(N-methyl-N-β-cyanoethylamino)-phenyl]-pyridine, 4-(2-hydroxy-4-diethylaminophenyl)-pyridine, 4-[4-(N-methyl-N-benzylamino)phenyl]-pyridine, 4-(4-N,N-dibutylaminophenyl)-pyridine, 4-(4-N,N-diethylaminophenyl)-pyridine, 4-[4-(N-methyl-N-phenylamino)-phenyl]-pyridine, 4-[4-(N-methyl-N-β-chloroethylamino)-phenyl]-pyridine, 4-[4-(N-ethyl-N-β-ethoxyethylamino)-phenyl]-pyridine, 2,6-diphenyl-4-(4-N,N-dimethylaminophenyl)-pyridine, 2,6-diphenyl-4-[4-(N-methyl-N-benzylamino)-phenyl]-pyridine, 2,6-diphenyl-4-[4-(N-benzyl-N-β-cyanoethylamino)-phenyl]-pyridine, 2,6-diphenyl-4-(4-N,N-dibenzylaminophenyl)-pyridine, 2,6-di-(4-chlorphenyl)-4-(4-N,N-dimethylaminophenyl)-pyridine, 2,6-diphenyl-4-(2-methyl-4-N,N-dimethylaminophenyl)-pyridine, 2,6-diphenyl-4-(2-ethoxy-4-N,N-diethylaminophenyl)-pyridine, 2,6-diphenyl-4-[4-(N-methyl-N-β-cyanoethylamino)-phenyl]-pyridine, 2,6-diphenyl-4-[4-(N-methyl-N-phenylamino)-phenyl]pyridine, 2,6-diphenyl-4-[4-(N-methyl-N-β-chloroethylamino)-phenyl]-pyridine and 2,6-diphenyl-4-[4-(N-methyl-N-β-ethoxyethylamino)-phenyl]-pyridine.

The pyridine derivatives employed in this invention can be prepared, for example, in the following known manner.

(1) 4-di-substituted aminobenzaldehyde, or aryl vinyl ketone having the formula,

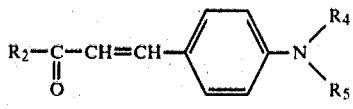

is condensated with a ketone having the formula, $R_1-\underset{\underset{O}{\|}}{C}-CH_3$ in the presence of ammonia or an ammonia-releasing agent (Journal of The American Chemical Society 74, 200 (1952)).

(2) The pyridine derivatives, in which $R_1$ and $R_2$ on the pyridine ring are hydrogen, can be prepared by condensing N,N-di-substituted aniline with pyridine and benzoyl chloride, optionally in the presence of copper powder (LIEBIGS Annalen der Chemie 509, 142 (1934)).

Although the pyridine derivative compounds having the formula [I] are colorless or slightly colored solid materials under ordinary conditions, when the compounds are heated, for example, at a temperature of from 100° to 200° C., for 30 seconds, the compounds sublime and develop a clear yellow color having a high color density on an electron acceptor, such as clay paper and resin paper. The melting points, the visual appearance of the crystals and the hue on the electron acceptor, of the typical compounds prepared in the above-mentioned manner, are shown in the following Table.

| No. | $R_1$ | $R_2$ | $R_3$ | $R_4$ | $R_5$ | Melting point (°C.) | Visual Appearance | Hue Electron Acceptor |
|---|---|---|---|---|---|---|---|---|
| 1 | H | H | H | $CH_3$ | $CH_3$ | 231–234 | Pale Yellow | Yellow |
| 2 | H | H | H | $CH_2$—⬡ | $CH_2$—⬡ | 190–191 | " | " |
| 3 | H | H | $CH_3$ | $CH_3$ | $CH_3$ | 164–169 | " | " |
| 4 | H | H | $OC_2H_5$ | $C_2H_5$ | $C_2H_5$ | 120–121 | " | " |
| 5 | H | H | OH | $C_2H_5$ | $C_2H_5$ | 169–172 | Pale Yellowish Brown | " |
| 6 | H | H | H | $CH_3$ | $C_2H_4CN$ | 134–135 | Pale Yellow | " |
| 7 | H | H | H | $CH_3$ | $CH_2$—⬡ | 115–118 | " | " |
| 8 | H | H | H | n-$C_4H_9$ | n-$C_4H_9$ | 145–148 | " | " |
| 9 | H | H | H | $C_2H_5$ | $C_2H_5$ | 156–158 | Pale Yellow | " |
| 10 | H | H | H | $CH_3$ | $C_2H_4Cl$ | 144–145 | " | " |
| 11 | H | H | H | $CH_3$ | ⬡ | 127–129 | " | Yellowish orange |
| 12 | H | H | H | $C_2H_5$ | $C_2H_4OC_2H_5$ | 118–121 | " | Yellow |
| 13 | ⬡ | ⬡ | H | $CH_3$ | $CH_3$ | 138–139 | " | Yellowish orange |
| 14 | ⬡ | ⬡ | H | $CH_3$ | $CH_2$—⬡ | 110–112 | Pale Yellow | Yellow |
| 15 | ⬡ | ⬡ | H | $CH_2$—⬡ | $C_2H_4CN$ | 168–169 | " | " |
| 16 | ⬡ | ⬡ | H | $CH_2$—⬡ | $CH_2$—⬡ | 182–186 | " | " |
| 17 | Cl—⬡ | Cl—⬡ | H | $CH_3$ | $CH_3$ | 167–168 | " | Yellowish orange |
| 18 | ⬡ | ⬡ | $CH_3$ | $CH_3$ | $CH_3$ | 120–123 | " | Yellow |
| 19 | ⬡ | ⬡ | $OC_2H_5$ | $C_2H_5$ | $C_2H_5$ | 114–116 | " | " |
| 20 | ⬡ | ⬡ | H | $CH_3$ | $C_2H_4CN$ | 126–128 | " | " |
| 21 | ⬡ | ⬡ | H | $CH_3$ | ⬡ | 104–107 | Pale Yellow | Yellowish orange |
| 22 | ⬡ | ⬡ | H | $CH_3$ | $C_2H_4Cl$ | 140–144 | " | Yellow |
| 23 | ⬡ | ⬡ | H | $CH_3$ | $C_2H_4OC_2H_5$ | 119–122 | " | " |

In the above Table, $R_1$, $R_2$, $R_3$, $R_4$ and $R_5$ are the same as defined above. The color developing conditions are as follows. A 1% solution of each compound in methylene chloride is impregnated into a baryta paper sheet. After drying the paper sheet at an ambient temperature, electron acceptor paper, such as paper having coated and dried clay thereon, is placed over the baryta paper sheet, in such a manner that the coated clay layer is in contact with the baryta paper, and is heated at a temperature of 190° C., for 5 seconds.

Leuco Auramine dye has been heretofore known as a sublimable color-former capable of developing a yellow color (U.S. Pat. No. 4,054,712). However, this color-former is not stable at an ambient temperature and its excitation purity is less than 50%. Thus, the clarity of the image formed from such color-former is practically insufficient. Contrary to this, the excitation purity of the present sublimable color-formers, i.e. pyridine derivatives having the general formula [I], are about 65% to 90% and; therefore, the clarity of the image derived therefrom is practically satisfactory. The term "excitation purity" used herein corresponds with the definition given in the Encyclopedia of Chemical Technology edited by Kirk-Othmer Vol. 5 (second completely revised edition) at page 805.

The carrier which supports the sublimable color-formers of the present invention must be able to transmit light. Examples of such carriers are transparent resin binders such as, styrene resin, styrene-butadiene resin, acrylic acid ester resin, gelatine, polyvinyl alcohol resin, phenol resin, epoxy resin and melamine resin; transparent resin beads such as, those made from acrylic acid ester resin, styrene resin, epoxy resin, phenol resin and melamine resin and; glass beads. These carriers can be advantageously dyed or colored by suitable coloring agents, such as organic or inorganic dyes and pigments, to easily provide a color separation function which is necessary for the reproduction of a color image.

Since the sublimable color-formers used in the present invention are substantially colorless even when they are supported or carried on the above-mentioned carriers, they do not adversely affect the optical properties of the previously dyed carriers. Therefore, the optimal use of the sublimable color-formers occurs when the particle develops a complementary color with respect to the color of the dyed particle.

The present invention will be illustrated in detail with reference to the accompanying drawings showing the preferred embodiments. However, the present invention is not intended to be limited by these drawings.

FIG. 1 shows particle 1, according to one embodiment of the present invention, formed by particulately or molecularly dispersing a coloring agent and the sublimable color-formers of the formula [I] in a transparent resin binder and, then, granulating the dispersion in the conventional manner.

Figure 1:
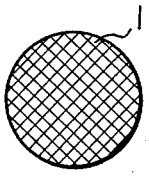
FIGS. 1 to 3 are schematic drawings showing the typical constructions of the preferred embodiments of the particles according to the present invention.
Figure 2:
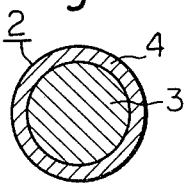

FIG. 2 shows a typical construction of particle 2 according to another embodiment of the present invention. Particle 2 is composed of a layer 4 containing the sublimable color-formers of the formula [I] coated over a light transmitting bead 3 made from, for example, glass, acrylic acid ester resin or styrene resin. Bead 3 may be dyed with a coloring agent. The layer 4 is formed by particulately or molecularly dispersing the sublimable color-formers [I] in a transparent resin binder. The coating of this layer 4 onto the bead 3 can be conveniently performed in any conventional manner, such as a spray dry coating or a fluidized bed coating.

Figure 3:
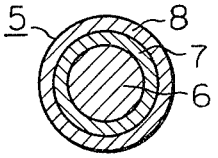

FIG. 3 shows a typical construction of a particle 5 according to a further embodiment of the present invention. The particle 5 comprises an innermost nucleus of a transparent bead 6 made from, for example, glass, acrylic acid ester resin or styrene resin, an intermediate coloring agent layer 7 composed of the above-mentioned transparent resin binder and a coloring agent, and an outermost sublimable color-former layer 8 containing the above-mentioned transparent resin binder and the sublimable color-former [I] dispersed particulately or molecularly therein. The coating of the coloring agent layer 7 and the sublimable color-former layer 8 over the bead 6 can be performed in any order. That is, it is possible to first coat the sublimable layer 8 over the entire surface of the bead 6 and then coat the coloring agent layer 7 thereover. A preferable coloring agent can include, for example, acid dyes, basic dyes, direct dyes or metal complex dyes.

For optimum results, the amount of the sublimable color-former present in 100 parts by weight of transparent binder should be within the range of from about 0.1 to about 20 parts by weight, and the amount of the coloring agent present in 100 parts by weight of transparent binder be within the range of from about 1 to about 20 parts by weight. When the amount of the sublimable color-former is less than 0.1 parts by weight based on 100 parts by weight of the binder, insufficient reflective color density is obtained. When the amount of the sublimable color-former is more than 20 parts by weight based on 100 parts by weight of the binder, excess color density is undesirably shown. Similarly, when the amount of the coloring agent is less than the above-mentioned lower limit, insufficient color separation is obtained. On the other hand, when the amount of the coloring agent is more than the above-mentioned upper limit, transparent beads cannot be obtained.

The above-mentioned light transmitting particles 1, 2 and 5 should preferably be spherical with a diameter of within the approximate range of a few microns to about 80 microns. The thickness of each of the layers 4, 7 and 8 is not limited to any special values, provided each layer substantially covers the entire surface of the particle, thickness although it should preferably be within the range of from about 0.1 to about 5 microns.

The principle of the image forming process in which the light transmitting particles of the present invention are employed is as follows. The light transmitting particles of the present invention are caused to adhere electrostatically onto a photosensitive plate having a photoconductive layer and, then, such particles are imagewise exposed to discharge those particles on the radiated or irradiated portions of the photosensitive plate. The discharged particles are removed from the photosensitive plate by appropriate external force. Thus, an image composed of the remaining particles is formed on the photosensitive plate. By heating the particle image together with an electron acceptor, the sublimable color-former contained in the particles is sublime and developed on the electron acceptor to form a color image. As mentioned above, since the sublimable color-former [I] is use separately with the electron acceptor, an advantage is brought about because the characteristics of the photosensitive plate are not adversely affected. Any conventional photosensitive plate for electrophotography can be used. Such photosensitive plate can be, for example, zinc oxide photosensitive paper, metallized selenium plate, cadmium sulfide photosensitive plate or polyvinyl carbazole film.

The electron acceptor can be, for example, activated clay, tartaric acid, bisphenol A (2,2-bis(4'-oxyphenyl)-propane) or p-phenyl phenol resin. The electron acceptor can be incorporated into the photosensitive plate or transfer paper. If the electron acceptor is present in the photosensitive plate, a developed color image of the sublimable color-former can be obtained on the photosensitive plate. On the other hand, if the electron acceptor is contained in the transfer paper, then a developed color image can be obtained on the transfer paper.

The light transmitting particle of the present invention can be used not only for obtaining a monochromatic yellow image having a high clarity (or color definition) and a high reflection density but also for obtaining a mixed or full color image together with other sublimable color-formers, as will be illustrated in detail with reference to the accompanying drawings.

Figure 4:
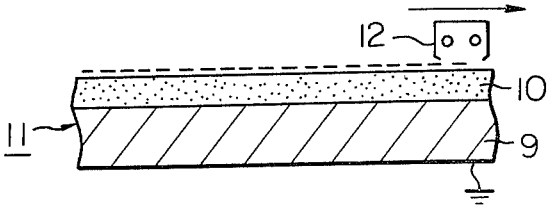
FIGS. 4 to 9 are schematic drawings showing the principle of the monochromatic or single-colored image forming process using the particles according to the present invention.
Figure 5:
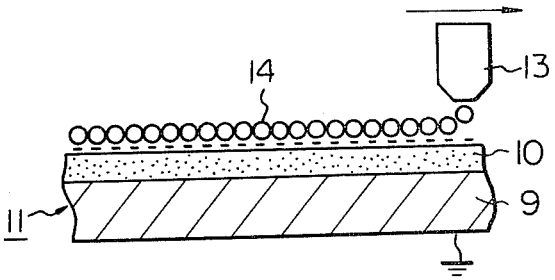
Figure 6:
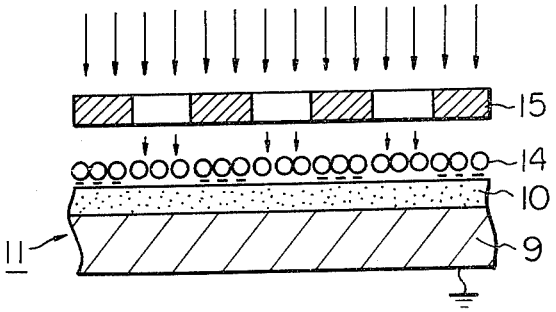
Figure 7:
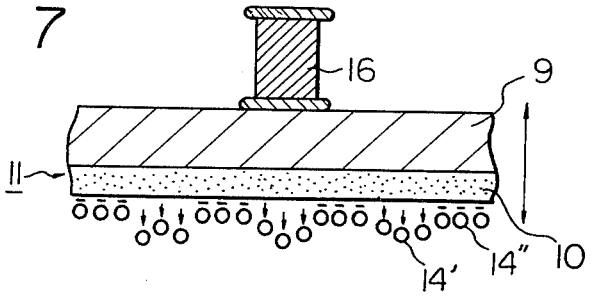
Figure 8:
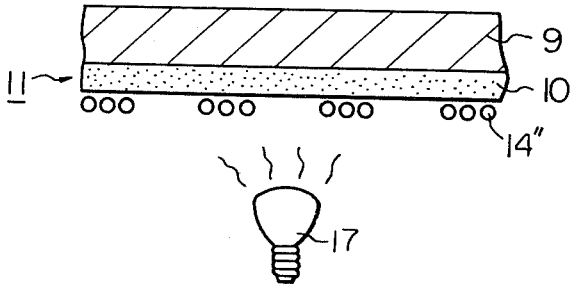
Figure 9:
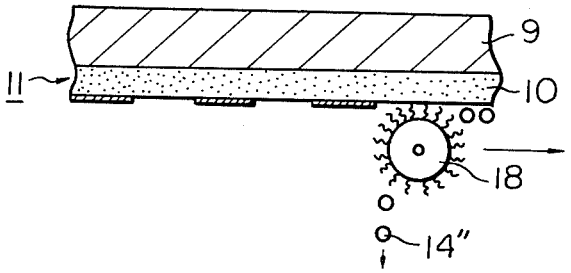

A method for obtaining a monochromatic or single-color image will first be illustrated with reference to FIGS. 4 to 9. In FIG. 4, a photoconductive support or a photo-sensitive plate 11, comprising a conductive or semi-conductive base 9 and a layer 10 of photoconductive material containing an electron acceptor, is electrostatically charged in a dark place by means of, for example, a corona charger 12 to generate a negative charge on the surface of the plate 11. If the photoconductive material is of a p-type semi-conductor, a positive charge is naturally generated. Light transmitting particles 14 for forming a color image are then spread over the entire surface of the photosensitive plate 11 which is negatively charged by an appropriate particle dispenser 13 (please refer to FIG. 5). Thus, the particles 14 are caused to adhere electrostatically to the plate 11. The particles 14 are preferably placed in approximately one layer. Then, as shown in FIG. 6, the particles 14 are imagewise exposed through an original 15 and the charge of the radiated portions of the particles 14 is removed or weakened by the light. The particles 14' having weakened or removed electrostatic attracting force are taken out of the photosensitive plate 11 by vibrating the plate 11 with, for example, a magnetic vibrator 16 (see FIG. 7). Thus, the particles 14" applied with an electrostatic force are left on the support 11 to obtain a particle image. The particle image is then heated, as shown in FIG. 8, by means of, for example, an infrared lamp 17, whereby the sublimable color-former present in the particles 14" is sublimed and reacted with the electron acceptor present in the layer 10 to develop a yellow color. As shown in FIG. 9, the particles 14" are then removed from the surface of the plate 11 by means of, for example, a cleaning brush to form a yellow image corresponding to the original 15.

The sublimable color-formers to be employed in the above-mentioned image forming process must exhibit the following characteristics.

(1) The color-formers must be stable at an ambient temperature. That is, they cannot be sublimed or deteriorated by, for example, aerial oxidation during storage.

(2) The reflection density in the powder form should be 0.15 or less.

(3) The color-formers must be sublimed by heating to develop a color on the electron acceptor. The heating must be carried out under such conditions that the photoconductive material and the electron acceptor are not thermally deteriorated within a relatively short time, for example, within 20 seconds at a temperature of about 200° C. Furthermore, the reflection color density of the developed color must be 0.7 or more.

(4) The stability during storage, resistance to light and clarity (excitation purity), of the color-developed dye must be high.

(5) The color-formers must not develop a color during manufacture of light transmitting particles and, further, must not adversely affect the optical properties of the particles.

The above-mentioned sublimable color-formers used in the present invention, that it, pyridine derivatives having the general formula [I], satisfy all of the requirements stated above. As a result, an excitation purity between 65% and 90% can be obtained.

The light transmitting particle of the present invention can be also used, together with other types of sublimable color-formers, in a process for obtaining a mixed or full color image, especially by one exposure and one development.

In order to obtain a full color image, a subtractive color process employing, as image forming materials, magenta, cyan and yellow dye materials is utilized. Therefore, it is necessary to use three types of particles, that is, (1) light transmitting particles G which transmit a green light and develop a magenta color;

(2) light transmitting particles R which transmit a red light and develop a cyan color, and;

(3) light transmitting particles B which transmit a blue-purple light and develop a yellow color.

The selective light transmitting properties of the particles can be affected by dyeing the particles with a coloring agent. Suitable coloring agents include, for example, acid dyes, basic dyes, direct dyes, or metal complex dyes. Typical coloring agents for transmitting a green light are, for example, C.I. Acid Green 9, 27, 40, 41 and 43; C.I. Basic Green 1 and 4; C.I. Pigment Green 2 and 7. Examples of a red light transmitting coloring agent are C.I. Acid Red 6, 14, 18, 27, 42, 82, 83, 85, 87, 133 and 211; C.I. Basic Red 14, 27, 32 and 34; C.I. Pigment Red 2, 5, 6, 11, 12 and 27. Examples of a blue-violet light transmitting coloring agent are C.I. Acid Blue 23, 40, 62, 83, 113, 120 and 183; C.I. Direct Blue 86; C.I. Basic Blue 7, 22, 26 and 65; C.I. Pigment Blue 2, 15 and 17.

The other color-formers which are used together with the sublimable color-formers [I] for developing a yellow color must satisfy the following requirements:

(1) the sublimation rates are substantially identical to each other;

(2) the coloring materials for each color are miscible with each other, and;

(3) the color-formers can be developed with a common electron acceptor.

Such sublimable color-formers for developing a magenta color which satisfy the above-mentioned requirements are, for example, 4-(1,3,3-trimethylindolino) methyl-7-(N-methyl-N-phenyl) amino-1',3',3'-trimethyl-spiro [2H-1-benzopyran-2,2'-[2H]-indole, 4-(1,3,3,-trimethylindolino)methyl-7-(N,N-diethyl)-amino-1',3',3'-trimethyl-spiro[2H-1-benzopyrane-2,2'-[2'H]-indole and 4-(1,3,3,5-tetramethyl-indolino)methyl-7-(N-methyl-N-phenyl)amino-1',3',3',5'-tetramethylspiro[2H-1-benzopyran-2-2'-[2'H]-indole].

The sublimable color-formers for developing a cyan color are, for example, acyl leucophenoxazine compounds. Typical acyl leucophenoxazine compounds are, for example, 3,7-bis-diethylamino-10-trichloroacetyl-phenoxazine, 3,7-bis-diethylamino-10-isobutyryl-phenoxazine, 3,7-bis-diethylamino-10-acetyl-phenoxazine, 3,7-bis-diethylamino-10-crotonoyl-phenoxazine, 3,7-bis-diethylamino-10-benzoyl-phenoxazine, 3,7-bis-diethylamino-10-dichloroacetyl-phenoxazine and 3,7-bis-diethylamino-10-monochloroacetyl-phenoxazine.

One embodiment of a process for forming a full color image in which three types of light transmitting particles one of which is the light transmitting particle of the present invention, are employed, will be illustrated with reference to FIGS. 10 to 13.

Figure 10:
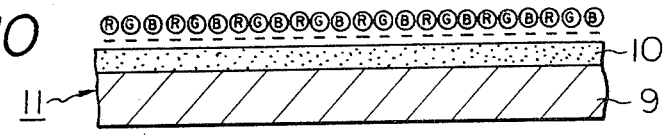
FIGS. 10 to 13 are schematic drawings showing the principle of the full-color image forming process using the particles according to the present invention.
Figure 11:
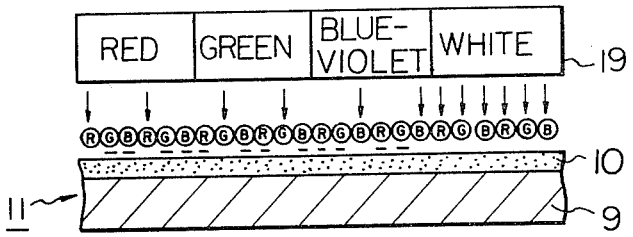
Figure 12:
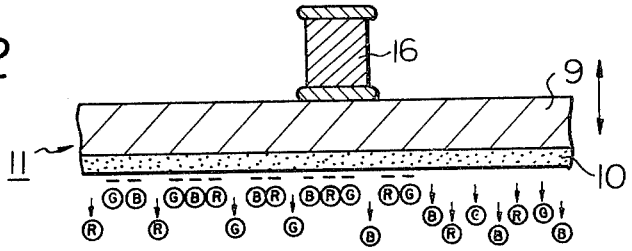

As shown in FIG. 10, the above-mentioned three types of light transmitting particles R, G and B are spread randomly over the entire surface of a panchromatic photosensitive plate 11 which comprises a conductive or semi-conductive base 9 and a layer of photoconductive material 10 and which is negatively charged. The particles R, G and B are caused to strongly and electrostatically adhere to the surface of the photosensitive plate 11. The particles R, G and B are exposed through a color original 19 comprising red, green, blue-violet and white in a manner as shown in FIG. 11. Thus, the radiated portions of the photosensitive plate 11 are discharged, thereby losing the electrostatic adhesion force. Accordingly, when the photosensitive plate 11 is vibrated by means of, for example, a magnetic vibrator 16, the particles contacting the discharged portions of the photosensitive plate 11 are removed from the plate 11 and only the particles contacting the charged portions of the photosensitive plate 11 are left on plate 11 (see FIG. 12).

Figure 13:
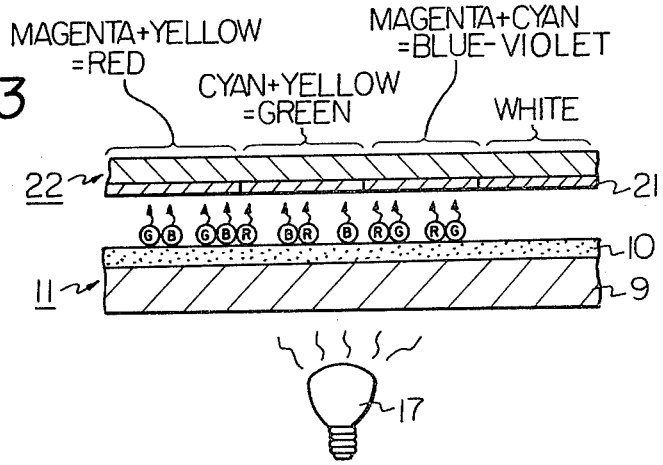

Thereafter, a sheet of transfer paper 22 having the above-mentioned electron acceptor layer 21 is placed over the photosensitive plate 11 as shown in FIG. 13 and heated, whereby the sublimable color-formers present in each remaining particle are sublimed and adsorbed into the electron acceptor to develop each color. For example, in the portion exposed by a red light, where the particles G and B are left, the mixed color of magenta and yellow dye, that is, red color, is reproduced upon heating. The other portions exposed by green, blue-violet and white light reproduce the respective colors of the original 19 as shown in FIG. 13.

The image forming processes using the light transmitting particles of the present invention will be further illustrated by the following Examples. However, the present invention is by no means limited by such Examples.

EXAMPLE 1

70 g of the compound No. 13 listed in the above Table (i.e. a sublimable color-former for developing a yellow color) and 10 g of a styrene-butadiene copolymer resin were dissolved in 1 kg monochlorobenzene. Into this solution 1 kg of glass beads was added and completely mixed therewith. By using a rotary coater, the mixture was mixed, dried, and then coated upon the surface of the glass beads. Thus, colorless transparent particles were obtained.

On the other hand zinc oxide photosensitive paper sheets were electrostatically charged in a dark place. The transparent particles prepared as mentioned above were spread over the charged photosensitive sheets and most of the excess particles were removed therefrom. Thus, the particles were placed on the entire surface of the photosensitive sheets in approximately a single layer.

The photosensitive sheets thus obtained were then imagewise exposed and, thereafter, the photosensitive sheets were vibrated in such a way that the particles adhering onto the surface of the photosensitive sheets were caused to face downwardly. The particles which were placed on the radiated portions of the photosensitive sheets fell from the photosensitive sheets, and the remaining particles formed an image on the photosensitive sheet.

Bottom paper (resin paper) sheets for pressure-sensitive copying paper containing, as a main component, p-phenyl phenol, were placed over the particles remaining on the photosensitive sheets serving as transfer paper means, and were heated at a temperature of 200° C. for 7 seconds. When the bottom sheets were pulled off, a clear yellow image corresponding to the original was obtained on each transfer paper means. The color density of the image portions was 1.2, and the density of the non-image portions was substantially zero (i.e., little fogging was observed).

EXAMPLE 2

300 g of melamine and 30 g of C.I. Acid Blue 83, Kayanol Cyanin 6B (manufactured by Nippon Kayaku Co., Ltd.), i.e. a blue-violet transmission coloring agent, were dissolved in 700 g of water. The resultant solution was heated and dried by using a spray dryer to produce blue-violet particles. Into 100 g of the blue-violet particles thus obtained, 5 g of the compound No. 4 listed in the above Table (i.e. a sublimable color-former), 0.5 g of poly(vinyl acetate)resin, 20 g of toluene and 80 g of trichloroethylene were added and mixed together. The resultant mixture was spray-dried by using a spray dryer to produce blue-violet particles coated with the sublimable color-former over the entire surface thereof. The color of the coated particles was substantially the same as that of the uncoated particles.

Zinc oxide photosensitive paper sheets were electrostatically charged in a dark place. The particles coated with the above-mentioned color-former were spread over the charged photosensitive sheets and most of the excess particles were removed therefrom. Thus, the particles were placed on the entire surface of the photosensitive sheets is approximately one single layer.

The photosensitive sheets thus prepared were then imagewise exposed through a color original and, then, the exposed photosensitive sheets were vibrated in such a way that the particles adhering to the surface of the photosensitive sheets were caused to face downwardly. The particles which were located on the radiated portions of the photosensitive sheets fell from the photosensitive sheets and the remaining particles formed a color-separated image by blue-violet light on the photosensitive sheets. That is to say, in portions of the photosensitive sheets corresponding to the portions of the original which did not contain a blue-violet color, the particles still adhered to the photosensitive sheets, whereas in the portions of the photosensitive sheets corresponding to the portions of the original which contained a blue-violet color, the particles were removed from the photosensitive sheets.

Bottom paper (clay paper) sheets for pressure-sensitive copying paper containing, as a main component, activated clay were placed over the remaining particles on the photosensitive sheets serving as transfer papers, and heated at a temperature of 200° C. for 5 seconds. When the transfer paper was pulled off, a clear yellow image was obtained at the portions where the particles adhered thereto. The color density of the image portions was 1.00, and the density of the non-image portions was substantially zero (i.e. little fogging was observed).

EXAMPLE 3

Example 1 was repeated, except that each compound selected from the compounds No. 1 through No. 3 and No. 5 through No. 12 listed in the above Table was used instead of the compound No. 13. Thus, in each case, a clear yellow image corresponding to the original was obtained on each transfer paper. The color density of the image portions was 1.0 or more which completely satisfied the objects of the present invention, and the density of the non-image portions (i.e. fogging) was substantially zero.

EXAMPLE 4

Example 2 was repeated, except that each compound selected from the compounds No. 14 through No. 23 listed in the above Table was used, as a sublimable color-former producing a yellow color, instead of the compound No. 4. Thus, in each case, an image was obtained, in which the particles adhered to the photosensitive sheets in the portions corresponding to the portions of the original which did not contain a blue-violet color, whereas the particles were removed from the photosensitive sheets corresponding to the portions of the original which contained a blue-violet color.

Bottom paper (clay paper) sheets for pressure-sensitive copying paper containing, as a main component, activated clay were placed over the remaining particles on the photosensitive sheets serving as transfer papers, and heated at a temperature of 200° C. for 5 seconds. When the transfer paper was pulled off, a clear yellow image was obtained at the portions where the particles adhered thereto. The color density of the image portions was 1.0 or more, which completely satisfied the objects of the present invention and the density of the non-image portions was substantially zero (i.e. little fogging was observed).

EXAMPLE 5

A liquid composition A was prepared by adding 15 g of C.I. Acid Red 265, Mitsui Brilliant Milling Red BL (manufactured by Mitsuitoatsu Chemical Co., Ltd.), i.e. a red light transmitting coloring agent, and 6 g of 3,7-bis-diethylamino-10-trichloroacetyl-phenoxazine, (i.e. a sublimable color-former providing a cyan image to 2 kg of a 5% aqueous polyvinyl alcohol solution, and then, by completely mixing all of the components together.

A liquid composition B was prepared by adding 20 g of C.I. Acid Green 41, Suminol Milling Cyanin Green 6G (manufactured by Sumitomo Chemical Ind., Ltd.), i.e. a green light transmitting coloring agent, and 3 g of 4-(1,3,3-trimethylindolino)methyl-7-(N-methyl-N-phenyl)-amino-1',3',3',-trimethyl-spiro [2H-1-benzopyran-2,2'-[2H]-indole], i.e. a sublimable color-former providing a magenta image, to 2 kg of a 5% aqueous polyvinyl alcohol solution, and then, completely mixing all of the components together.

A liquid composition C was prepared by adding 16 g of C.I. Acid Blue 83, Kayanol Cyanin 6B (manufactured by Nippon Kayaku, Co., Ltd.), i.e. a blue-violet light transmitting coloring agent, and 8 g of the compound No. 1 listed in the above Table, i.e., a sublimable color-former providing a yellow image, to 2 kg of a 5% aqueous polyvinyl alcohol solution, and then, by completely mixing all of the components together.

The liquid compositions A, B and C, prepared as described above, were separately granulated by spray drying and particles of each composition having diameters of 37 to 44 microns were obtained after being subjected to a size screening process. 5 g of each group of particles were taken out and mixed together to prepare a mixture of particles for forming a color image.

On the other hand, a tartaric acid in acetone solution was coated, as a thin film, onto a zinc oxide photosensitive plate, which was previously subjected to a conventional panchromatic treatment, and thereafter, the coated plate was kept in a dark place.

The photosensitive plate thus obtained was then subjected to a conventional corona charge treatment in a dark place. When the mixture of particles, prepared as described above, was spread over the entire surface of the charged photosensitive plate, the particles for forming a color image were caused to electrostatically adhere to the charged surface of the photosensitive plate.

The photosensitive plate was imagewise exposed through a color original, and then, the plate was vibrated as described previously to remove particles located on the irradiated portions of the plate. The plate was then heated by means of an infrared lamp and, thereafter, the particles located on the plate were removed with a cleaning brush. Thus, a color image substantially identical to the original was reproduced on the plate. For instance, a red image was formed in the portions of the photosensitive plate corresponding to the red portions of the original by a mixture of magenta and yellow images which were obtained from a sublimable color-former for providing a magenta image and a sublimable color-former for providing a yellow image, respectively. As the heating temperature was increased, the amount of the sublimed sublimable color-former was increased so that a color image was spread over the photosensitive plate. When the heating was carried out at a temperature of 190° C. for 20 seconds, a clear color print having a moderate image spread and having a good color mixture was obtained.

What we claim is:

1. A light transmitting particle for use in the formation of a color image in an electrophotographic process comprising:

(i) 100 parts by weight of a carrier selected from the group consisting of transparent resin binders, transparent resin beads and glass beads (ii) from about 0.1 to about 20 parts by weight of at least one sublimable pyridine derivative which has the general formula [I]:

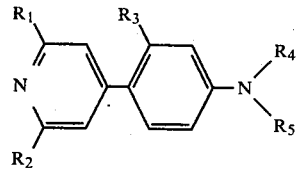

[I]

wherein $R_1$ and $R_2$ are independently hydrogen, phenyl group or chlorine substituted phenyl groups, $R_3$ is hydrogen, lower alkyl groups or lower alkoxy groups, $R_4$ and $R_5$ are independently lower alkyl groups, benzyl group or phenyl group, said lower alkyl groups may be substituted with a cyano group, chlorine or lower alkoxy groups;

wherein said sublimable pyridine derivative is characterized by producing a yellow color on heating in the presence of an electron acceptor, and (iii) from about 1 to about 20 parts by weight of a coloring agent selected from the group consisting of acid dyes, basic dyes, direct dyes and metal complex dyes.

2. A light transmitting particle as claimed in claim 1, wherein said pyridine derivative is selected from 4-(4-N,N-dibenzylaminophenyl)-pyridine, 4-(4-N,N-dimethylaminophenyl)-pyridine, 4-(2-methyl-4-N,N-dimethylaminophenyl)-pyridine, 4-(2-ethoxy-4-N,N-diethylaminophenyl)-pyridine 4-[4-(N-methyl-N-β-cyanoethylamino)-phenyl]-pyridine, 4-(2-hydroxy-4-diethylaminophenyl)-pyridine, 4-[4-(N-methyl-N-benzylamino)-phenyl]-pyridine, 4-(4-N,N-dibutylaminophenyl)-pyridine, 4-(4-N,N-diethylaminophenyl)-pyridine, 4-[4-(N-methyl-N-phenylamino)-phenyl]-pyridine, 4-[4-(N-methyl-N-β-chloroethylamino)-phenyl]-pyridine, 4-[4-(N-ethyl-N-β-ethoxyethylamino)-phenyl]-pyridine, 2,6-diphenyl-4-(4-N,N-dimethylaminophenyl)-pyridine, 2,6-diphenyl-4-[4-(N-methyl-N-benzylamino)-phenyl]-pyridine, 2,6-diphenyl-4-[4-(N-benzyl-N-β-cyanoethylamino)-phenyl]-pyridine, 2,6-diphenyl-4-(4-N,N-dibenzyl-aminophenyl)-pyridine, 2,6-di-(4-chlorophenyl)-4-(4-N,N-dimethylaminophenyl)-pyridine, 2,6-diphenyl-4-(2-methyl-4-N,N-dimethylaminophenyl)-pyridine, 2,6-diphenyl-4-(2-ethoxy-4-N,N-diethylaminophenyl)-pyridine, 2,6-diphenyl-4-[4-(N-methyl-N-β -cyanoethylamino)-phenyl]-pyridine, 2,6-diphenyl-4-[4-(N-methyl-N-phenylamino)-phenyl]-pyridine, 2,6-diphenyl-4-[4-(N-methyl-N-β-chloroethylamino)-phenyl]-pyridine and 2,6-diphenyl-4-[4-(N-methyl-N-β-ethoxyethylamino)-phenyl]-pyridine.

3. A light transmitting particle for forming a color image as claimed in claim 1, wherein said particle contains at least one blue-violet coloring agent.

* * * * *

UNITED STATES PATENT AND TRADEMARK OFFICE

CERTIFICATE OF CORRECTION

PATENT NO. : 4,262,078

DATED : 4/14/81

INVENTOR(S) : Eisuke Ishida et al

It is certified that error appears in the above—identified patent and that said Letters Patent is hereby corrected as shown below:

Column 1, line 21, delete "between the particles and".

Column 10, line 40, "is" should read --in--.

Signed and Sealed this

*First* Day of *September 1981*

[SEAL]

*Attest:*

GERALD J. MOSSINGHOFF

*Attesting Officer*

*Commissioner of Patents and Trademarks*